US007331540B2

(12) United States Patent
Klaumünzner

(10) Patent No.: US 7,331,540 B2
(45) Date of Patent: Feb. 19, 2008

(54) DISPERSING DEVICE

(75) Inventor: Uwe Klaumünzner, Münstertal (DE)

(73) Assignees: Frymakoruma AG, Rheinfelden (CH); Frymakoruma GmbH, Neuenburg (DE)

( * ) Notice: Subject to any disclaimer, the term of this patent is extended or adjusted under 35 U.S.C. 154(b) by 26 days.

(21) Appl. No.: 10/503,964

(22) PCT Filed: Feb. 21, 2002

(86) PCT No.: PCT/IB02/00546

§ 371 (c)(1),
(2), (4) Date: Jul. 27, 2005

(87) PCT Pub. No.: WO03/066203

PCT Pub. Date: Aug. 14, 2003

(65) Prior Publication Data

US 2006/0016922 A1 Jan. 26, 2006

(30) Foreign Application Priority Data

Feb. 7, 2002 (DE) ..... 102 04 921

(51) Int. Cl.
*B02C 13/20* (2006.01)
*B02C 7/00* (2006.01)

(52) U.S. Cl. ..... 241/188.2; 241/259.1

(58) Field of Classification Search ..... 241/188.1, 241/188.2, 46.04, 46.08, 257.1, 259.1, 101.8, 241/301

See application file for complete search history.

(56) References Cited

U.S. PATENT DOCUMENTS

| | | | | |
|---|---|---|---|---|
| 3,420,456 A * | 1/1969 | Ugalde et al. | ..... | 241/46.04 |
| 3,514,079 A | 5/1970 | Little | | |
| 4,428,536 A * | 1/1984 | Rodgers | ..... | 241/52 |
| 4,637,555 A | 1/1987 | Furuichi et al. | | |
| 5,195,684 A * | 3/1993 | Radzins | ..... | 241/57 |
| 5,540,499 A | 7/1996 | Seeger | | |

FOREIGN PATENT DOCUMENTS

| | | |
|---|---|---|
| CH | 271 109 | 10/1950 |
| DE | 825 084 | 7/1949 |
| DE | 1 772 035 | 8/1958 |
| DE | 34 17 242 A1 | 11/1985 |
| DE | 296 08 713 U1 | 9/1996 |
| EP | 0 620 039 | 10/1994 |
| EP | 1 121 974 A1 | 8/2001 |
| GB | 733 693 | 7/1955 |
| GB | 1 500 901 | 2/1978 |
| JP | 01 038132 | 2/1989 |
| NL | 1 008 622 | 9/1999 |

* cited by examiner

*Primary Examiner*—Faye Francis
(74) *Attorney, Agent, or Firm*—Collard & Roe, P.C.

(57) ABSTRACT

In a device for the dispersion of, in particular, low-viscosity to high-viscosity mixtures of substances, including a container having one or more openings for introducing the substances to be dispersed and one or more openings for discharging the dispersed substances, and at least one rotor and one stator, the at least one rotor being mounted for rotation relative to the stator about an axis of rotation, for the purpose of dispersing the substances that have been introduced into the container, fast and precisely metered introduction of substances at a controlled rate is achieved in that the stator is mounted for reciprocation in the direction of the rotation axis of the rotor and can be displaced by a displacement device within a specified range of movement and can be locked in an arbitrary position.

11 Claims, 4 Drawing Sheets

DISPERSING DEVICE

CROSS REFERENCE TO RELATED APPLICATIONS

Applicant claims priority under 35 U.S.C. §119 of German Application No. 102 04 921.0 filed on Feb. 7, 2002. Applicant also claims priority under 35 U.S.C. §365 of PCT/IB02/00546 filed on Feb. 21, 2002. The international application under PCT article 21(2) was not published in English.

BACKGROUND OF THE INVENTION

1. Field of the Invention

The invention relates to a device for the dispersion of, in particular, low-viscosity to high-viscosity mixtures of substances, comprising a container with one or more openings for introducing the substances to be dispersed and one or more openings for discharging the dispersed substances, and at least one rotor and one stator, said at least one rotor being rotatably mounted relative to said stator about an axis of rotation for the purpose of dispersing the substances that have been introduced into the container.

2. The Prior Art

Dispersing units of the type mentioned above are usually employed in the prior art for the purpose of mixing liquid substances with other liquid or powdered substances such that a substantially homogeneous deagglomerated composition is formed. However, the prior dispersing units all suffer from the drawback, in particular, that it is not readily possible to carry out fast introduction of the substances. Furthermore, with the known dynamic devices, the input of energy into the substances to be dispersed can only be controlled during a dispersing operation by effecting a change of speed of a rotor. A change of the energy input over and above this would only be possible by the use of additional devices provided, for example, by installing other dispersing implements. Suitable devices would be multistage implements or the like. In addition, this could only be accomplished by dismantling the existing dispersing system.

SUMMARY OF THE INVENTION

Thus it is an object of the present invention to provide a dispersing unit, by means of which, in particular, fast introduction of substances is possible and a change in the energy input can be effected irrespective of the speed of a rotor.

This object is achieved for a device of the type mentioned above in that the stator is mounted for reciprocation in the direction of the rotation axis of the rotor and can be displaced by a displacement device within a specified range of movement and can be locked in an arbitrary posit-ion.

Preferred embodiments of the invention are the subject matter of the sub-claims.

In the dispersing unit of the invention, the fact that the stator is mounted for reciprocation in the direction of the rotation axis of the rotor and can be displaced by a displacement device within a specified range of movement and may be locked in an arbitrary position means that a dispersing unit is created by means of which an intense pumping action is produced by axially shifting the stator away from the dispersing zone. This ensures that substances can be introduced either with intense shearing or very quickly depending on their wetting properties. Furthermore, the input of energy into the product to be treated is influenced depending on the state of engagement of the stator in the dispersing zone.

According to a first preferred embodiment of the device of the invention, provision is made for the displacement device to comprise a displacement screw provided on the outside wall of the container and having a double male thread comprising two parallel individual threads spaced from each other to form a clearance, whilst a nut covering both individual threads can be rotatably displaced along the double male thread, the stator being connected to the nut by a pin passing through an oblong hole in the wall of the container.

According to another preferred embodiment of the device of the invention, provision is made for the rotor to have coaxial teeth. The pumping properties of the device of the invention may be enhanced by suitably designing the coaxial teeth. Furthermore, pumping impellers can be mounted on the base of the rotor at the back. In addition, in preferred embodiments the stator is also provided with coaxial teeth.

According to another preferred embodiment of the device of the invention, provision is made for the dispersing unit to be equipped with other implements. These may be conical or flat breakers. Furthermore, the coaxially toothed dispersing implements may be multistage implements.

According to an important preferred embodiment of the device of the invention, provision is made for the stator to be substantially in the form of a hollow cylinder which is partially open at one end and open at the other end. In conjunction with a stator thus designed, two rotors are provided of which one is located in the vicinity of the outer lateral surface of the stator and the other in the vicinity of the inner lateral surface of the stator. One rotor is preferably substantially in the form of a hollow cylinder having one open end and one closed end, which forms a baseplate, the closed end of said rotor being opposite to the partially open end of the stator, during operating, and a rotor is preferably provided with coaxial teeth in the region of its open end. The partially open end of the stator can form an outlet opening for the dispersed product.

In the device of the invention, preferably one or more premix impellers are provided within the container, mounted on a shaft which is in line with the longitudinal axis of the container.

In order to be able to introduce a large quantity of material into the container, the container, which preferably has the form of a hollow cylinder, is positioned vertical and above it there is provided a bin having an upper, cylindrical part and a lower, cone-shaped part or a part having the form of a spherical sector, which cone-shaped part or part having the form of a spherical sector adjoins an upper part of the container or an open end of the container. In order to provide a premixing function, an stirrer is preferably provided in the bin.

In order to achieve multiple treatment of the substances to be dispersed in the container, the device of the invention is preferably provided with a piping system which leads from a discharge opening for the substances to the cone-shaped part of the bin or the part having the form of a spherical sector, this embodiment being preferred when smaller quantities are to be placed in the container. For the same purpose there is alternatively or additionally provided a piping system which leads from a discharge opening for the substances to the cylindrical part of the bin. This embodiment is preferred when larger quantities of material are to be placed in the container.

According to another important preferred embodiment of the device of the invention, provision is made for the stator to be in the form of an ultrasonic sonotrode (sound emitter). The ultrasonic sonotrode can be substantially in the form of a hollow cylinder which is partially open at one end and open at the other end and which, when transverse ultrasonic vibrations are introduced at the partially open end, automatically assumes at least one vibrational mode in which the distance of the cylinder wall from the central longitudinal axis of the cylinder periodically changes.

BRIEF DESCRIPTION OF THE DRAWINGS

The contrivance of the invention is explained below with reference to a preferred embodiment, which is illustrated in the accompanying drawings, in which.

DETAILED DESCRIPTION OF PREFERRED EMBODIMENTS

Figure 1:
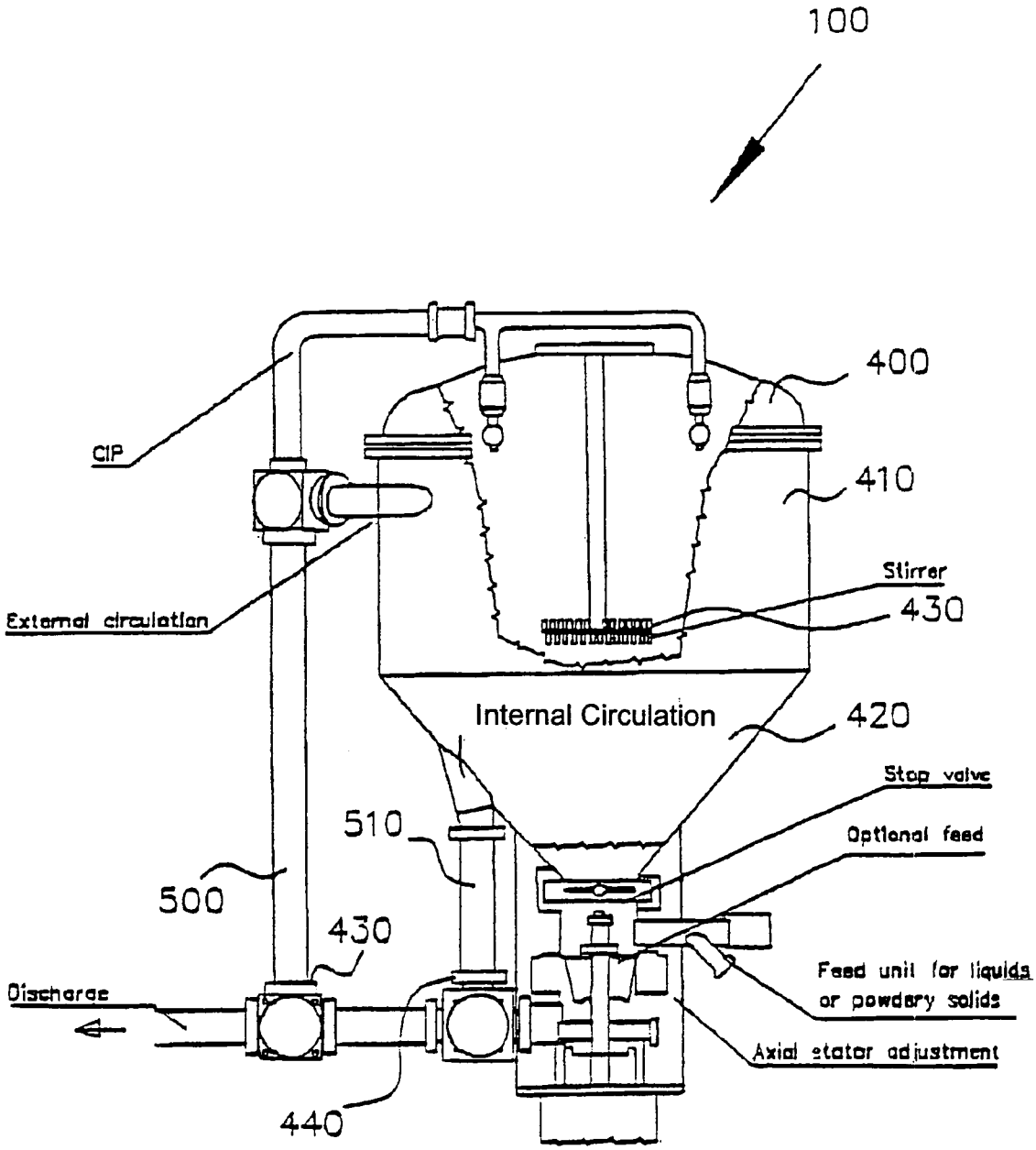
FIG. 1 is a cross-sectional view of a first preferred embodiment of the device of the invention.
Figure 2:
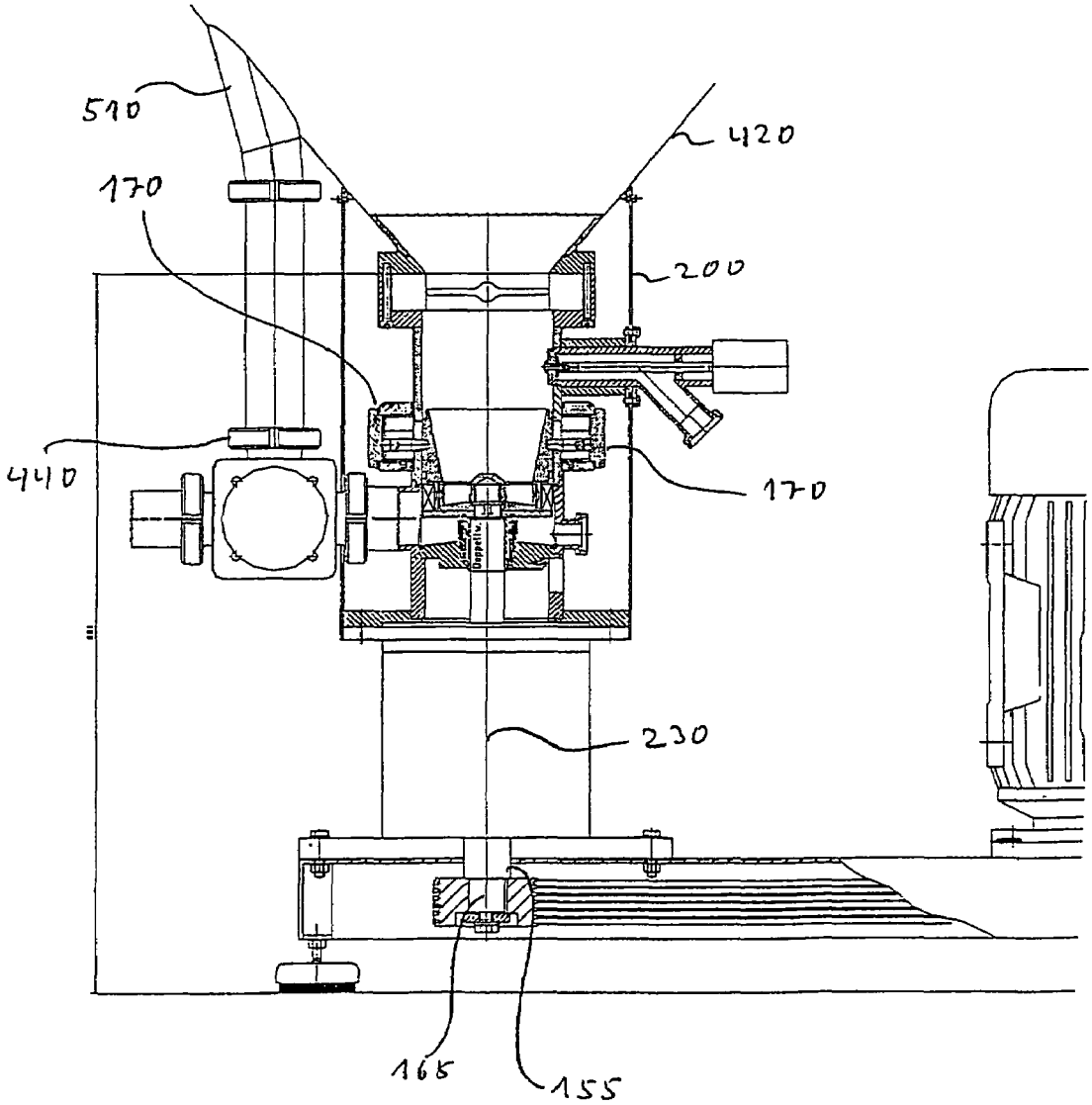
FIG. 2 is a cross-sectional view of an enlarged portion of the preferred embodiment of the device of the invention illustrated in FIG. 1.
Figure 3:
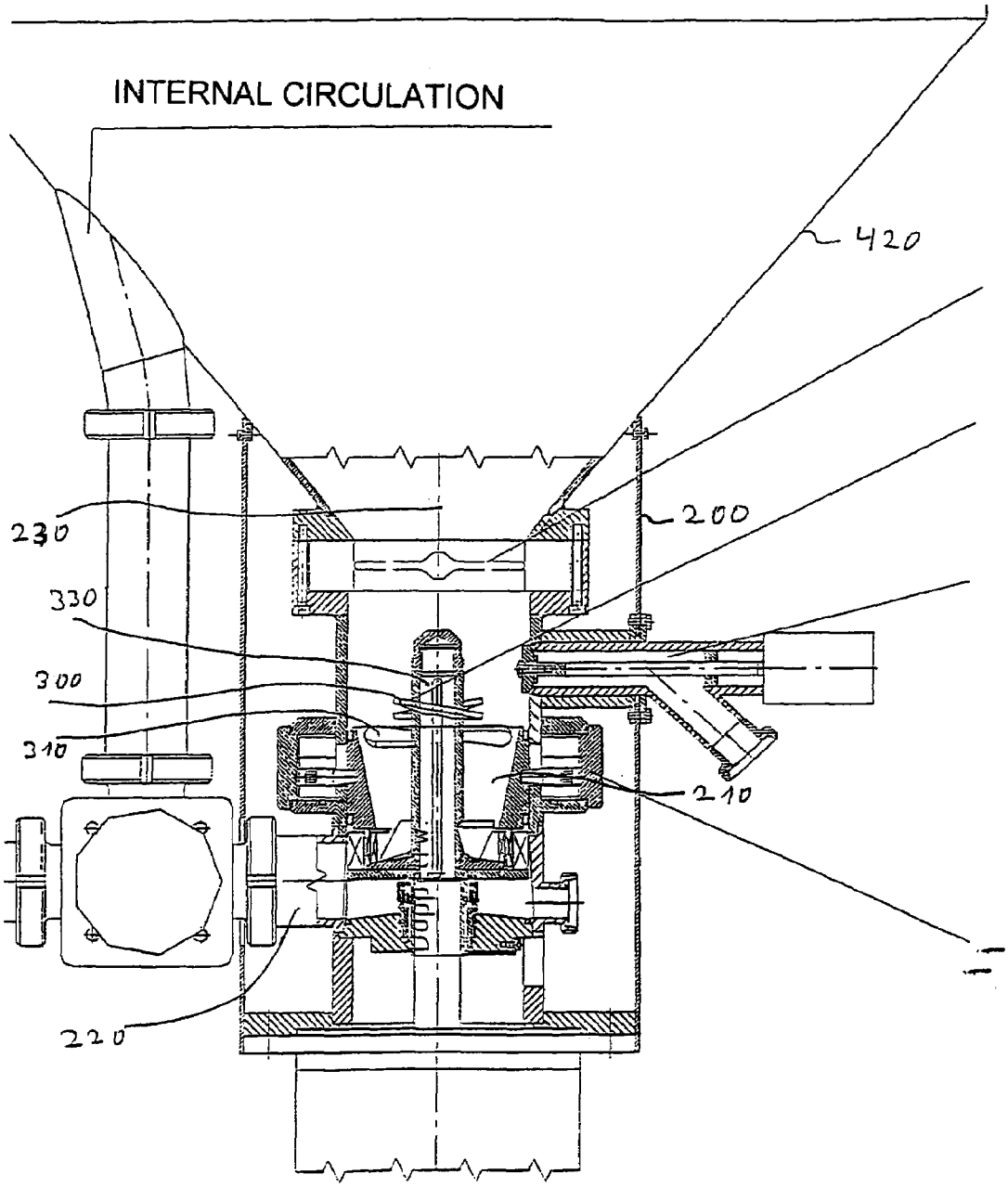
FIG. 3 is a cross-sectional view of an enlarged portion of the preferred embodiment of the device of the invention illustrated in FIG. 2.
Figure 4:
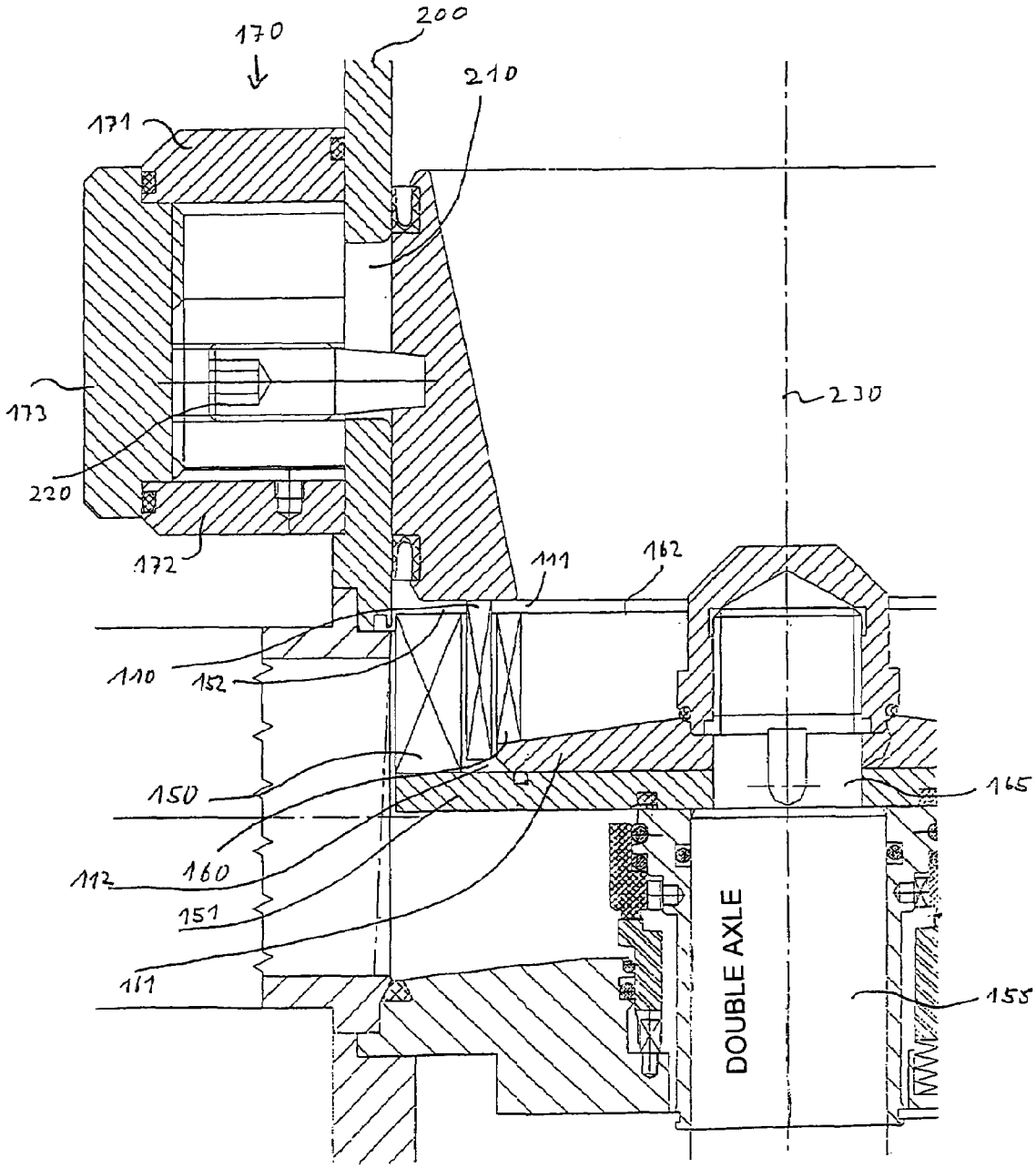
FIG. 4 is a cross-sectional view of an enlarged portion of the preferred embodiment of the device of the invention illustrated in FIG. 3.

The device 100 of the invention illustrated in FIGS. 1 to 4 for the dispersion of, in particular, low-viscosity to high-viscosity substances has a container 200 with an opening 210 for the introduction of the substances to be dispersed and also an opening 220 for the discharge of the dispersed substances and contains two rotors 150, 160 and a stator 110, which rotors 150, 160 are each mounted for rotation relatively to stator 110 about a rotation axis 155, 165 for the purpose of dispersing substances that have been introduced into container 200. Stator 110 is, according to an essential feature of the invention, reciprocally mounted in the direction of rotation axis 155 of rotor 150 and can be displaced by means of a displacement device 170 within a specified range of movement and can be releasably locked in an arbitrary position. On account of the pumping action produced during the displacement caused by displacement device 170, the substances to be introduced can be filled in slowly or quickly with a high degree of precision depending on their wettability.

Displacement device 170 comprises a double male thread provided on the outside wall of the container and having two parallel individual threads 171, 172 spaced from each other so as to form a clearance, and a nut 173 covering both individual threads 171, 172 is rotatably displaceable along the double male thread, and stator 110 is connected to nut 173 by a pin 220 passing through an oblong hole 210 in the wall of container 200.

The two rotors 150, 160 are substantially in the form of hollow cylinders having a closed end forming a baseplate 151, 161 and an open end 152, 162 and provided with coaxial teeth in the region of said open end 152 and the adjoining lateral surface. One of rotors 150 is disposed in the vicinity of the outer lateral surface of stator 110 and the other rotor 160 is disposed in the vicinity of the inner lateral surface of stator 110.

Stator 110 is likewise substantially in the form of a hollow cylinder and partially open at one end 111 and open at the other end 112. Stator 110 is provided with coaxial teeth in the region of its lateral surface, which teeth are in the form of slits in the lateral surface adapted to allow the passage therethrough of a substance to be dispersed.

Within the container there are provided premix impellers 300, 310, which are mounted on a shaft 330 in line with the longitudinal axis 230 of container 200, and above container 200 there is provided a bin 400 having an upper, cylindrical part 410 and a lower, cone-shaped part 420, in which bin 400 there is provided an stirrer 430. The cone-shaped part 420 of bin 400 is adjacent an upper part 240 of container 200.

A piping system 500 leads from a discharge opening 430 for dispersed substances to the cone-shaped part 420 of bin 400, and another piping system 510 leads from a discharge opening 440 for dispersed substances to the cylindrical part 410 of bin 400.

The depicted dispersing unit of the invention is distinguished in that stator 110 is in the form of an ultrasonic sonotrode (sound emitter), which is substantially a hollow cylinder which is partially open at one end and is open at the other end and assumes, when ultrasonic vibrations are introduced, at least one vibrational mode in which the distance of the cylinder wall from the central longitudinal axis of the cylinder periodically changes.

The embodiment of the invention explained above merely serves the purpose of providing better clarification of the teaching of: the invention defined by the claims, which is not, as such, restricted to this embodiment.

The invention claimed is:

1. A device for dispersing low-viscosity to high-viscosity mixtures of substances comprising (a) a container comprising an outside wall having an oblong hole, at least one introduction opening for introducing the substances to be dispersed, and at least one discharge opening for discharging the substances following dispersion;

(b) a dispersing unit comprising at least one stator and at least one rotor mounted for rotation relative to said at least one stator about an axis of rotation for dispersing the substances that have been introduced into the container; and (c) a displacement device for displacement of said at least one stator within a selected range of movement, said displacement device comprising a double male thread provided on said outside wall and a nut rotatably displaceable along said double male thread, said double male thread having two parallel individual threads spaced from each other so as to form a clearance, said nut covering both individual threads;

wherein said at least one stator is mounted for reciprocation toward said axis of rotation, is lockable in an arbitrary position, and is connected to said nut by a pin passing through said oblong hole.

2. The device as defined in claim 1, wherein said at least one rotor is substantially in the form of a hollow cylinder which is open at one end and closed at the other end so as to form a baseplate.

3. The device as defined in claim 2, wherein said rotor is provided with coaxial teeth in the region of said open end.

4. The device as defined in claim 1, wherein said at least one stator is substantially in the form of a hollow cylinder which is partially open at one end and is open at the other end.

5. The device as defined in claim 1, wherein two rotors are provided, of which one is located in the vicinity of the outer lateral surface of said stator and the other is located in the vicinity of the inner lateral surface of said at least one stator.

6. The device as defined in claim 1, wherein said dispersing unit comprises a plurality of coaxially toothed multistage dispersing implements.

7. The device as defined in claim 1, further comprising within said container at least one premix impeller mounted on a shaft in line with the longitudinal axis of said container.

8. The device as defined in claim 1, further comprising above said container a bin having an upper, cylindrical part and a lower, cone-shaped part adjacent an upper part of said container.

9. The device as defined in claim 8, wherein an stirrer is provided in said bin.

10. The device as defined in claim 8, wherein a piping system is provided which leads from said at least one discharge opening to said cone-shaped part of said bin.

11. The device as defined in claim 8, further comprising a piping system leading from said at least one discharge opening to said cylindrical part of said bin.

* * * * *